US005096752A

United States Patent [19]

Wagner

[11] Patent Number: 5,096,752

[45] Date of Patent: Mar. 17, 1992

[54] PLACEMAT WITH CHANGEABLE CARD DISPLAY

[76] Inventor: Eugene Wagner, 3424 Kingsbridge Rd., Chappaqua, N.Y. 10463

[21] Appl. No.: 544,993

[22] Filed: Jun. 28, 1990

Related U.S. Application Data

[63] Continuation-in-part of Ser. No. 407,195, Sep. 14, 1989.

[51] Int. Cl.[5] ..... G09F 1/10

[52] U.S. Cl. ..... 428/13; 40/152; 40/158.1; 40/642; 428/542.4; 428/904.4

[58] Field of Search ..... 40/136, 152, 158.1, 40/159, 642; 428/13, 542.4, 904.4

[56] References Cited

U.S. PATENT DOCUMENTS

| | | | |
|---|---|---|---|
| 1,356,892 | 10/1920 | Stevens | 40/159 |
| 3,920,870 | 11/1975 | Ackerman et al. | 428/13 X |
| 4,083,137 | 4/1978 | Rozmanith | 428/13 X |
| 4,263,357 | 4/1981 | Holson | 428/13 X |
| 4,738,888 | 4/1988 | Pantaleo et al. | 428/13 X |
| 4,771,557 | 9/1988 | Bowman | 40/159 X |
| 4,829,691 | 5/1989 | Manjos et al. | 40/642 X |
| 4,860,468 | 8/1989 | Cliborn | 40/159 X |
| 4,899,473 | 2/1990 | Wiener | 40/152 |
| 4,944,968 | 7/1990 | Wagner | 428/13 |

*Primary Examiner*—Henry F. Epstein
*Attorney, Agent, or Firm*—Natter & Natter

[57] ABSTRACT

A mat includes a front panel having a plurality of rectangular cut outs dimensioned to accommodate cards bearing the likeness of celebrities such as athletes. Each of the cut outs is covered with a clear plastic film overlay to provide a window for viewing the cards. A base panel is laminated to the front panel and encloses the cut outs to form a pocket for each card. Provided in the base panel adjacent an edge of each cut out is a slot for insertion and removal of cards. The front panel is imprinted with indicia coordinated with the activity of the celebrities depicted on the cards to be inserted in the various pockets.

14 Claims, 2 Drawing Sheets

PLACEMAT WITH CHANGEABLE CARD DISPLAY

RELATED APPLICATIONS

This application is a continuation in part of application Ser. No. 07/407,195 filed Sept. 14, 1989.

BACKGROUND OF THE INVENTION

1. Field of the Invention

This invention relates generally to placemats and more particularly to placemats for use by children and youth.

2. History of the Invention

For generations, children have purchased, collected and traded cards bearing depictions of sports heroes. With each new sports season, thousands of new cards were published while selected cards of the prior seasons became part of treasured collections. Some old cards have truly become collectors items and have commanded sales prices in the thousands of dollars.

Trading and collecting cards has been a favorite pass time of children with parents handing down their collections to offspring. While card collecting has been considered a hobby to be encouraged, some children and youth tended to be both disorganized and untidy. Their collections, often numbering hundreds of cards, were frequently disorganized and scattered. Parents have recognized a need for providing devices for storing and possibly sorting their childrens' card collections. Further, children have often desired to coordinate cards of selected players, for example, players on a particular team, or have fashioned their own "all star" team of favorite players from different teams.

Many parents have also appreciated the need for promoting a relaxed atmosphere at meal times for both digestive health purposes and their own mental well being.

SUMMARY OF THE INVENTION

In compendium, the present invention comprises a dining placemat which is formed of a base and a front paperboard panel. The front panel is provided with a plurality of rectangular cut outs. A clear plastic film overlays the front panel and provides a taut window for each cut out. Laminated to the back of the front panel is the base panel which provides a rear wall for the cut outs to form pockets. The base panel includes a slot registered with an end of each cut out for insertion and removal of celebrity cards.

Preferably, indicia coordinated with the theme or activity of the celebrities depicted on the cards appears on the front panel. For example, if the cards carry the depiction of baseball players, the indicia appearing on the front panel will comprise baseball related indicia. Should the cards carry the likeness of characters in a popular movie, the indicia may comprise a typical scene or environment of the movie story. Indicia may also be printed on the inner face of the base panel for viewing through the windows when cards are not seated in the pockets.

From the foregoing compendium, it will be appreciated that it is an aspect of the present invention to provide a mat with a changeable card display which is not subject to the disadvantages of the history of the invention aforementioned.

It is a consideration of the present invention to provide a mat with a changeable card display of the general character described which is low in cost and suitable for economical mass production fabrication.

A further aspect of the present invention to provide a mat with a changeable card display of the general character described which promotes organization skills and tidiness in children.

A feature of the present invention is to provide a placemat with a changeable card display of the general character described which is well adapted to relieve stressful events at meal times.

Another feature of the present invention is to provide a placemat with a changeable card display of the general character described which protects childrens' trading cards from damage while providing a functional meal time attribute.

A further consideration of the present invention is to provide a mat with a changeable card display of the general character described which includes a plurality of pockets for carrying selected childrens' trading cards.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations are attained all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENTS

Figure 1:
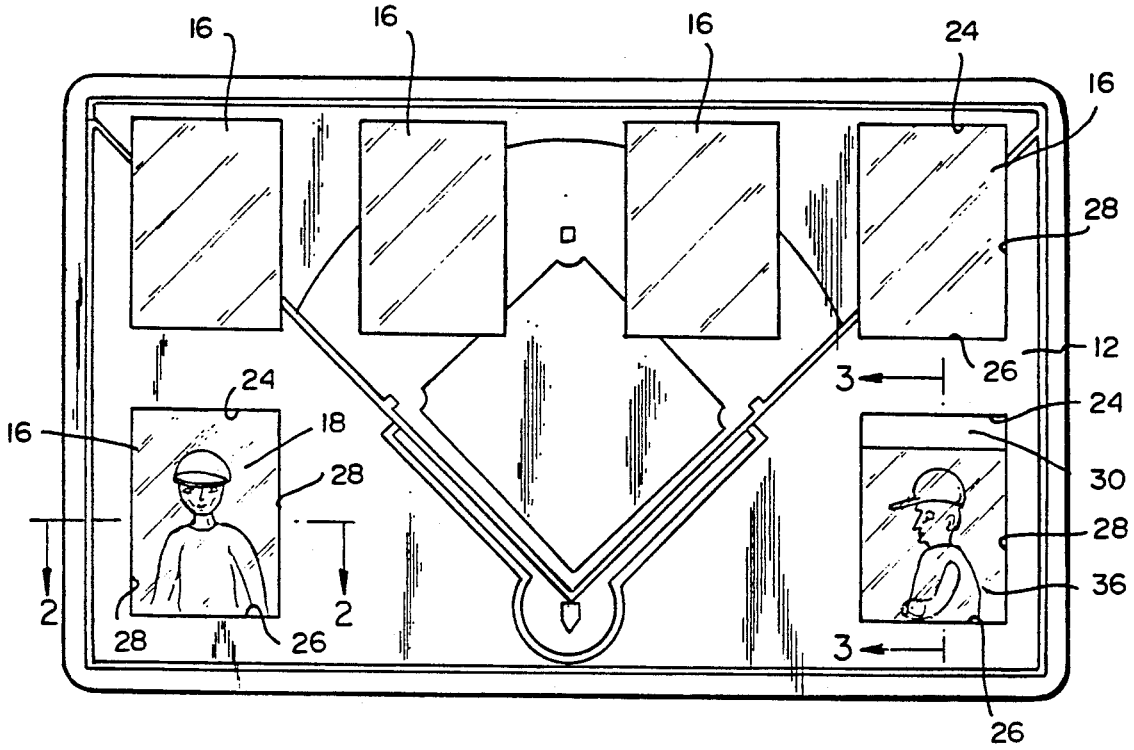
FIG. 1 is a plan view of a mat constructed in accordance with and embodying the invention and formed of front and base paperboard panels showing a plurality of windowed pockets each adapted to carry a card bearing the depiction of a baseball player.
Figure 2:
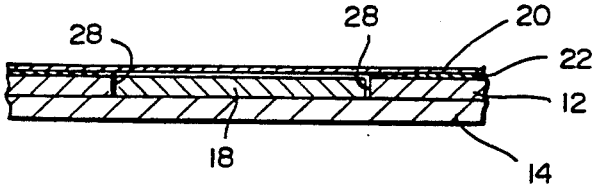
FIG. 2 is an enlarged scale fragmentary sectional view through the mat taken substantially along the line 2—2 of FIG. 1 and transversely through a single pocket carrying a selected card.

Referring now in detail to the drawings, the reference numeral 10 denotes generally a placemat with a changeable card display constructed in accordance with and embodying the invention. The placemat 10 is dimensioned to be positioned on a dining area and is suitable for the placement of dining utensils and dishes in a conventional place setting array.

The placemat 10 is constructed of a front paperboard panel 12 and a base paperboard panel 14. In accordance with the invention, the front panel 12 is provided with a plurality of rectangular cut outs 16 each dimensioned to receive a celebrity card 18 which preferably has a thickness not greater than the thickness of the front panel 12.

To protect the celebrity cards 18, seated in the cut outs 16, from damage or soiling due to food spills and the like, the entire upper surface of the front panel 12 is covered by a transparent plastic film overlay 20. The plastic film overlay 20 is clear and may be formed of a thermoplastic such as a polyester, for example, Mylar. A relatively thin plastic film overlay may be utilized, e.g. one-half mill in thickness.

In order to assure proper film overlay adhesion, and at the same time, assure that the area of the plastic film overlay which spans across each cut out 16 is taut and wrinkle free, the plastic film is preferably heat sealed over the front panel. For this purpose, a thin coating or layer of transparent heat seal adhesive 22 may be applied over the front panel 12. The heat seal adhesive 22 is selected from available adhesives which will not affect the transparency of the plastic film so that indicia which is imprinted on the front panel 12, as will later described, will be visible.

It should be noted that each of the cut outs 16 is formed with a top edge 24, a bottom edge 26 and a pair of parallel side edges 28. The base panel 14 is adhesively secured to the front panel 12 and substantially covers each of the cut outs 16 to provide a back wall. Thus, an enclosed space is formed between the base panel 14 and the plastic film overlay 20 to define a pocket for receiving each of the celebrity cards 18. In order to permit access to the pockets for inserting or removal of celebrity cards 18, the base panel 14 includes rectangular slots 30, each of which is registered with the top edge 24 of a cut out 16. Each rectangular slot 30 includes a central arcuate finger notch 32 which permits insertion of an index finger, for example, between a celebrity card 18 and the front panel 12, to thus facilitate removal of celebrity cards 18.

In accordance with the invention, the placemat constructed in accordance with the invention will be prededicated to celebrity cards 18 bearing depictions of celebrities of a particular subject or field, such as, for example, baseball, football, basketball or other sports activity or possibly celebrities from a popular movie or television series. In each instance, the front panel 12 will preferably include suitable indicia 34 relating to the subject of the celebrity cards. If, for example, the celebrity cards 18 bear the likeness of characters of a popular movie, the indicia 34 will comprise a scene or illustration relating to the theme of the movie. Illustrated in FIG. 1 is a placement 10 for displaying baseball celebrity cards 18; the indicia 34 comprises a ball field diamond.

Figure 3:
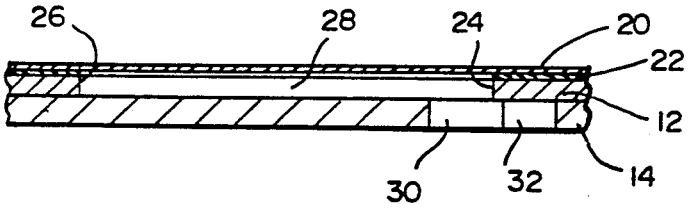
FIG. 3 is an enlarged scale fragmentary sectional view through the mat, the same being taken substantially along the line 3—3 of FIG. 1 and longitudinally through an empty pocket and showing a slot and finger notch cut in the base panel for access to the pocket.
Figure 4:
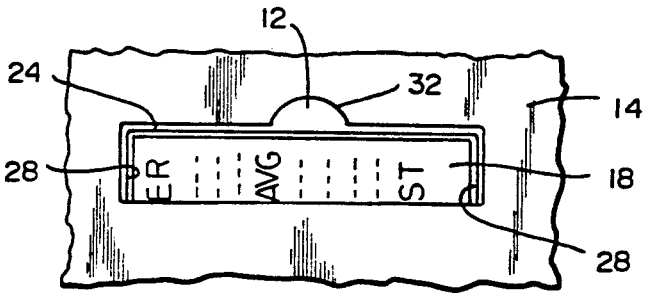
FIG. 4 is a fragmentary rear plan view showing a slot with a finger notch formed in the base panel for insertion and removal of celebrity cards into and out of a pocket.

It should also be noted that celebrity card indicia 36 may be imprinted on the inner face of the base panel 14 in a rectangular area beneath each of the slots 30 registered with the pocket windows. The indicia 36 provides a visual simulation of celebrity cards viewable through the plastic film windows prior to insertion of celebrity cards into the pockets. It should be noted from an examination of the cut out 16 appearing in the lower left hand corner of FIG. 3, an open area above the top edge of the indicia 36 and the top edge 24 of the cut out 16 is visible; such area comprises the opening of the rectangular slot 30, through the base panel.

Figure 5:
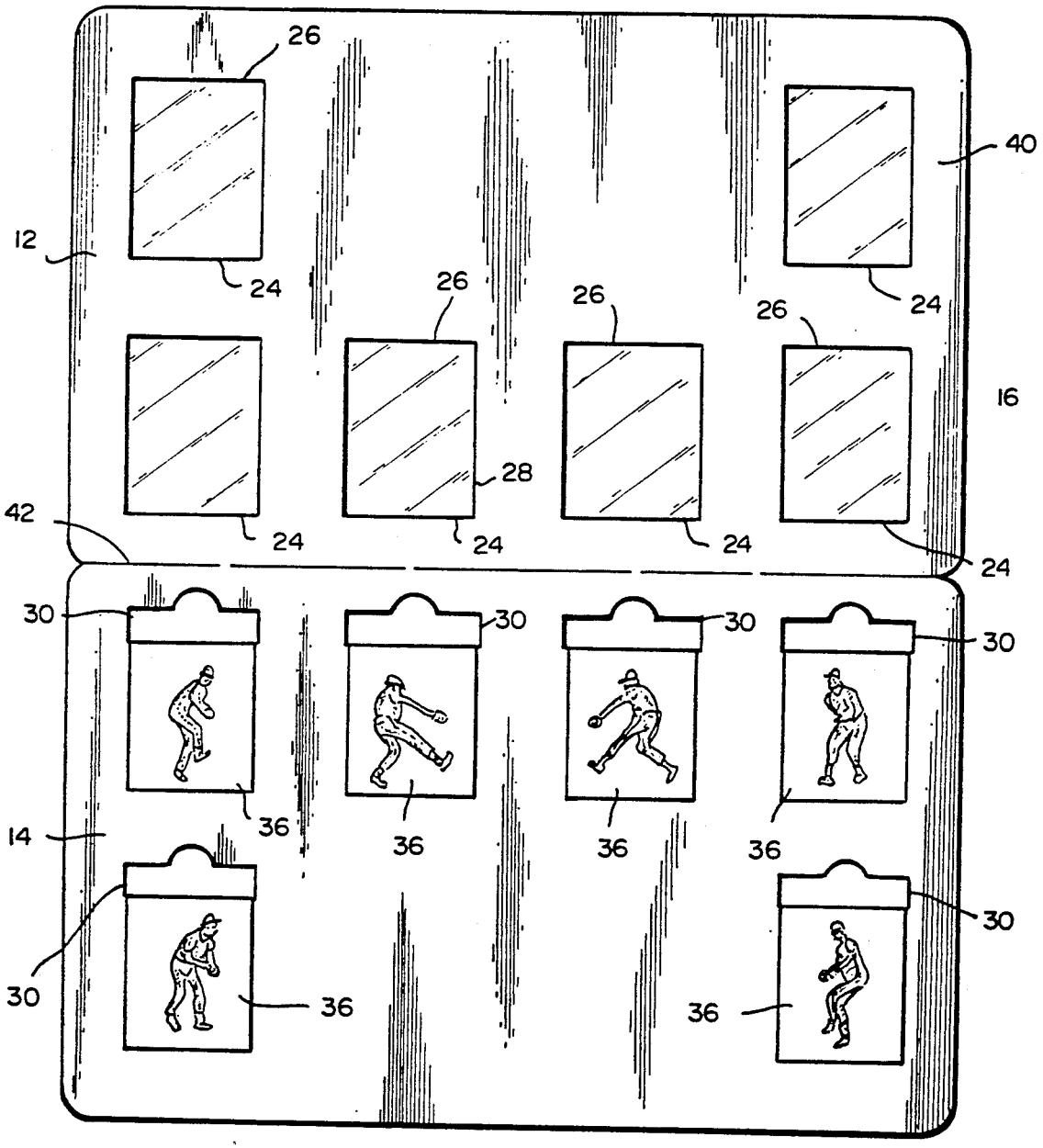
FIG. 5 is a plan view of a paperboard blank from which the mat is formed.

In FIG. 5 a plan view of a paperboard blank 40 suitable for fabrication into the placemat 10 is illustrated. The blank 40 includes the front and base panels 12, 14 separated by a fold line 42. The paperboard blank 40 may comprise a solid bleached sulphate food grade board. The front panel 12 is formed with the cut outs 16 and the base panel includes the rectangular slots 30. The outer face of the front panel is printed with the suitable front panel indicia 34. The plastic film overlay 20 is then heat sealed over the entire outer face of the front panel 12 or the entire blank 40.

If desired, the indicia 36 is printed on the inner face of the base panel 14. Such printing may take place before, after or simultaneously with the printing of the front panel indicia. Thereafter, a suitable coating of adhesive is applied between the panels, except for the areas of the cut outs 16, the slots 30 and the indicia 36. The blank is then folded along the fold line 42 so that the inner faces of each panel are joined together to form the composite placemat 10.

As will be readily appreciated, mats constructed in accordance with the invention are well suited for displaying various celebrity card collections of children, young adults and adults and foster collection and organizational traits in children.

Thus it will be seen that there is provided a mat with a changeable card display which achieves the various aspects, features and considerations of the present invention and which is well suited to meet the conditions of practical usage.

As various changes might be made in the mat with changeable card display as above set forth, it is to be understood that all matter herein described or shown in the accompanying drawings is to be interpreted as illustrative and not in a limiting sense.

Having thus described the invention there is claimed as new and desired to be secured by Letters Patent.

1. A mat for displaying celebrity cards, the mat comprising a front panel and a base panel, the panels being registered with one another, the front panel including a plurality of rectangular cut outs, each card bearing the depiction of a celebrity in a specific field, the width of each cut out being greater than the width of a celebrity card intended to be displayed, the heighth of each cut out being greater than the heighth of a celebrity card intended to be displayed and the thickness of the front panel being not less than the thickness of a celebrity card intended to be displayed, a single taut transparent plastic film overlaying the entire front panel and each cut out and providing a window for viewing a celebrity card, portions of the base panel registered with the cut outs defining a back wall, a pocket associated with each cut out for receiving a celebrity card, the pocket being defined by the cut out, the transparent plastic film overlay and the back wall, and means for insertion and removal of celebrity cards into and out of each pocket, the means for insertion and removal of cards comprising a slot formed in the base panel and associated with each cut out, each slot being registered with an edge of each cut out, the plastic film being liquid impervious, the front panel further including indicia, the indicia being related to the field of the celebrities depicted on the cards.

2. A mat for displaying celebrity cards as constructed in accordance with claim 1 wherein the plastic film overlay is secured to the front panel by heat sealing.

3. A mat for displaying celebrity cards as constructed in accordance with claim 1 further including a number of celebrity cards, each celebrity card of the number being carried in a pocket.

4. A mat for displaying celebrity cards as constructed in accordance with claim 3 wherein each celebrity card depicts the likeness of a sports celebrity and wherein the indicia comprises a representation of an athletic playing area associated with the sport of the celebrities depicted on the cards.

5. A mat for displaying celebrity cards as constructed in accordance with claim 1 wherein the front panel and the base panel are unitarily joined across a fold line.

6. A placemat for displaying celebrity cards as constructed in accordance with claim 1, the panels being dimensioned for placement on a dining surface and for accommodating a place setting.

7. A system for organizing and displaying a plurality of rectangular celebrity cards, each card including indicia comprising a depiction of a celebrity, the system including a front panel, the front panel carrying indicia, the front panel indicia comprising a scene associated with the celebrities depicted on the celebrity cards, the front panel further including a plurality of rectangular cut outs dimensioned to accommodate the celebrity cards, the front panel further including a clear plastic film overlay, the plastic film overlay providing a window for covering each cut out and to permit viewing of a celebrity card, the system further including a base panel, a plurality of pockets for receiving and displaying the celebrity cards, each pocket being defined by the cut out, the window and the base panel, the system further including means for accessing each pocket for insertion and removal of celebrity cards, the accessing means comprising a slot in the base panel registered with an edge of each cut out, each slot being substantially rectangular and including an arcuate finger notch, the arcuate finger notch, comprising means for permitting insertion of a finger between a celebrity card and the front panel for facilitating removal of a celebrity card from a pocket.

8. A system for organizing and displaying a plurality of celebrity cards as constructed in accordance with claim 7 further including indicia imprinted on the base panel, the base panel indicia being viewable through the window of a pocket when a celebrity card is not carried in the pocket.

9. A mat for displaying celebrity cards as constructed in accordance with claim 1 wherein the celebrities are sports celebrities, the front panel indicia comprising a representation of a playing field.

10. A mat for displaying celebrity cards as constructed in accordance with claim 1 further including a celebrity card carried in each pocket.

11. A mat displaying celebrity card as constructed in accordance with claim 1 further including discreet indicia imprinted on the back wall of each pocket, the discreet indicia being related to the field of the celebrities and being in registration with each cut out, whereby the mat will present coordinated celebrity associated images in the absence of celebrity cards being carried in each pocket.

12. A mat for displaying celebrity cards as constructed in accordance with claim 11 wherein the discreet indicia comprises a simulation of a celebrity card.

13. A mat for displaying celebrity cards as constructed in accordance with claim 11 wherein the front panel and the base panel are formed of a single paperboard blank, the panels being separated from one another along a fold line, whereby registration of the discreet images with their associated cut outs is facilitated.

14. A mat for displaying celebrity cards as constructed in accordance with claim 1 wherein the front panel and the base panel are formed of a single paperboard blank, the panels being separated from one another along a fold line.

* * * * *